US009993708B2

(12) United States Patent
Fox

(10) Patent No.: US 9,993,708 B2
(45) Date of Patent: Jun. 12, 2018

(54) SYSTEMS AND METHODS FOR A RETRIEVAL TOOL

(71) Applicant: Michael Fox, Cedar Park, TX (US)

(72) Inventor: Michael Fox, Cedar Park, TX (US)

( * ) Notice: Subject to any disclaimer, the term of this patent is extended or adjusted under 35 U.S.C. 154(b) by 0 days. days.

(21) Appl. No.: 15/465,267

(22) Filed: Mar. 21, 2017

(65) Prior Publication Data

US 2017/0274259 A1 Sep. 28, 2017

Related U.S. Application Data

(60) Provisional application No. 62/311,964, filed on Mar. 23, 2016.

(51) Int. Cl.

| | |
|---|---|
| ***A63B 67/06*** | (2006.01) |
| ***A63B 71/02*** | (2006.01) |
| *A63B 47/02* | (2006.01) |

(52) U.S. Cl.

CPC ..... *A63B 67/06* (2013.01); *A63B 71/02* (2013.01); *A63B 47/02* (2013.01)

(58) Field of Classification Search

CPC . B25J 1/04; A63B 47/02; A63B 65/10; A63B 67/06; A63B 71/02; A47F 13/06

USPC ..... 294/19.2, 19.3, 209, 210, 219, 82.21, 294/82.34

See application file for complete search history.

(56) References Cited

U.S. PATENT DOCUMENTS

| | | | | |
|---|---|---|---|---|
| 2,924,482 | A * | 2/1960 | Gibson | A01K 97/14 294/19.3 |
| 4,148,514 | A * | 4/1979 | McCullough | B66C 1/34 294/82.34 |
| 4,152,814 | A * | 5/1979 | Ito | F16B 45/02 24/599.3 |
| 5,388,877 | A * | 2/1995 | Wenk | B65H 75/406 224/162 |
| 5,823,590 | A | 10/1998 | Forrest et al. | |
| 6,237,977 | B1 * | 5/2001 | Johnson, Jr. | B66C 1/36 24/600.2 |
| 6,705,654 | B2 * | 3/2004 | Slauf | B25G 1/04 294/210 |
| 6,726,265 | B2 * | 4/2004 | Miller | A63B 47/024 294/19.2 |
| 7,240,439 | B2 | 7/2007 | Critelli et al. | |
| 7,320,489 | B1 | 1/2008 | Domb | |
| 7,434,330 | B2 | 10/2008 | McEwan et al. | |
| 7,677,620 | B1 * | 3/2010 | Tasey | A63B 47/02 294/210 |
| 8,104,811 | B2 * | 1/2012 | Seguin | A62B 99/00 269/3 |
| 8,397,426 | B2 | 3/2013 | Rodgers et al. | |
| 8,657,351 | B2 * | 2/2014 | Johnson | A63F 9/0001 135/74 |
| 8,745,826 | B2 | 6/2014 | Vangheluwe et al. | |
| 2011/0221219 | A1 | 9/2011 | Heaton | |
| 2012/0285430 | A1 | 11/2012 | Dunlop et al. | |

(Continued)

*Primary Examiner* — Dean J Kramer

(74) *Attorney, Agent, or Firm* — Pierson IP, PLLC

(57) ABSTRACT

Embodiments disclosed herein describe systems and methods for a retrieval tool, which is configured to secure object in place within the retrieval tool responsive to the object engaging with the retrieval tool. The retrieval tool may be utilized to grasp, secure, hold, etc. objects in a plurality of different circumstances, such as disc golf, grasping an object at a hard to reach place, more easily holding an object, etc.

19 Claims, 5 Drawing Sheets

(56) References Cited

U.S. PATENT DOCUMENTS

| | | | | |
|---|---|---|---|---|
| 2013/0047493 | A1 | 2/2013 | Rich et al. | |
| 2015/0015011 | A1 | 1/2015 | Silva | |
| 2017/0087421 | A1* | 3/2017 | Chabot ..... | A63B 47/02 |

* cited by examiner

SYSTEMS AND METHODS FOR A RETRIEVAL TOOL

BACKGROUND INFORMATION

Field of the Disclosure

Examples of the present disclosure are related to systems and methods for a retrieval tool. More particularly, embodiments relate to a retrieval tool with an actuating arm, which is configured to pivot over an object to secure the object in place.

Background

Disc golf has gained significant popularity, and continues to grow. During the game of disc golf, players attempt to throw a disc through a course to obtain various objectives. A disc golf course typically includes a number of obstacles, such as water hazards, trees, bushes, etc.

During play, a disc may land in these obstacles, wherein the disc may not be easily reachable by hand. Conventionally, if a player is unable to reach a disc, the player may have to abandon the disc, or be subject to unpleasantries, such as wading in water.

Current devices to retrieve objects and discs typically include a grasping arm, wherein a player is required to press a button to create pressure on the disc to secure the disc. However, these devices require the player to constantly and manually hold down a button to secure the disc in place. This procedure can be cumbersome while the player avoids the obstacles. Furthermore, the design of these conventional grasping devices allows a disc to slide out the front end of the grasping arm, which leads to undesirable results.

Accordingly, needs exist for more effective and efficient systems and methods for a retrieval tool with a pivoting arm that is configured to automatically rotate responsive to an object engaging with the retrieval tool.

SUMMARY

Embodiments disclosed herein describe systems and methods for a retrieval tool, which is configured to secure object in place within the retrieval tool responsive to the object engaging with and applying pressure on the retrieval tool. The retrieval tool may be utilized to grasp, secure, hold, etc. objects in a plurality of different circumstances, such as disc golf, grasping an object at a hard to reach place, more easily holding an object, etc.

In embodiments, the retrieval tool may include a base, trigger slide, shaft, spring, and lever.

The base may be a primary structure for the retrieval tool for grasping objects. The base may be configured to be coupled with the trigger slide, spring, shaft, and the lever. The base may include a proximal end, a body, and a distal end.

A proximal end of the base may include an attachment member, which may be configured to be coupled with a recoiling device, such as steel tape, a telescoping handle, etc. Utilizing the recoilable device, a length associated with the retrieval tool may increase or decrease.

The body of the base may include shaft orifices and a locking bar. The shaft orifices may be holes extending through sidewalls of the body that are configured to allow the shaft to be inserted through the body. The locking bar may be positioned on a lower surface of the body. The locking bar may be configured to engage with portions of the lever to limit the movement of the lever once the lever is engaged with the object.

The distal end of the base may include a tip and a staging area. The tip may include an angled, planar surface. The tip may be configured to engage with an object, and allow the object to side on and over the tip. The staging area may include a first end with a concave sidewall positioned adjacent to the tip and a surface extending towards the body. The staging area may be configured to receive the object, and the concave sidewall may be configured to limit the forward movement of the object.

The trigger slide may be a device that is configured to slide with respect with the base. The trigger slide may include an engagement mechanism, sliding slots, and a lever lock.

The engagement mechanism may be a projection positioned on a distal end of the trigger slide, wherein the engagement mechanism is configured to engage with the object. Responsive to the engagement mechanism engaging with the object, the engagement mechanism may move the trigger slide towards the proximal end of the base.

The sliding slots may be orifices extending through the sidewalls of the trigger slide. The sliding slots may have a length that is sufficient to allow the lever to be engaged and disengaged with the lever lock.

The lever lock may be a projection positioned on a proximal end of the trigger slide that is configured to selectively engage with the lever. Responsive to the lever lock engaging with the lever, the retrieval tool may be in a first mode. Responsive to the lever lock disengaging with the lever, the retrieval tool may be in a second mode, which secures the object in place.

The shaft may be a device that is configured to couple the base, trigger slide, spring, and lever together. The shaft may be configured to be inserted through the base, trigger slide, and the lever such that the components are coupled together. Furthermore, the shaft may define an axis that the lever is configured to rotate about.

The spring may be a device that is configured to be compressed and elongated. The spring may be compressed and elongated based on the position of the lever in relation to the lever lock.

The lever may be a device that is configured to be held in place by the lever lock in a first mode, and rotate around the shaft to secure an object in place in a second mode. The lever may include a locking mechanism positioned on a first end of the lever, a stopper positioned on a second end of the lever, and an arm positioned between the first end and the second end. The lever may also include an orifice, wherein the shaft is configured to extend through the orifice.

The locking mechanism may be a groove, shelf, indention, etc. positioned on the first end of the lever, wherein the locking mechanism is configured to engage with the lever lock in the first mode. When the locking mechanism is engaged with the lever lock, the shelf may be positioned directly under and adjacent to the lever lock, which may secure the locking mechanism in place.

The stopper may be a groove, shelf, indentation, etc. positioned on the second end of the lever. The stopper may be configured to allow the lever to rotate freely from the first mode to the second mode. While in the second mode the trigger slide may be configured to move freely, and the stopper may engage with the locking bar to limit the rearward movement of the lever.

These, and other, aspects of the invention will be better appreciated and understood when considered in conjunction with the following description and the accompanying drawings. The following description, while indicating various embodiments of the invention and numerous specific details thereof, is given by way of illustration and not of limitation. Many substitutions, modifications, additions or rearrangements may be made within the scope of the invention, and the invention includes all such substitutions, modifications, additions or rearrangements.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

Figure 1:
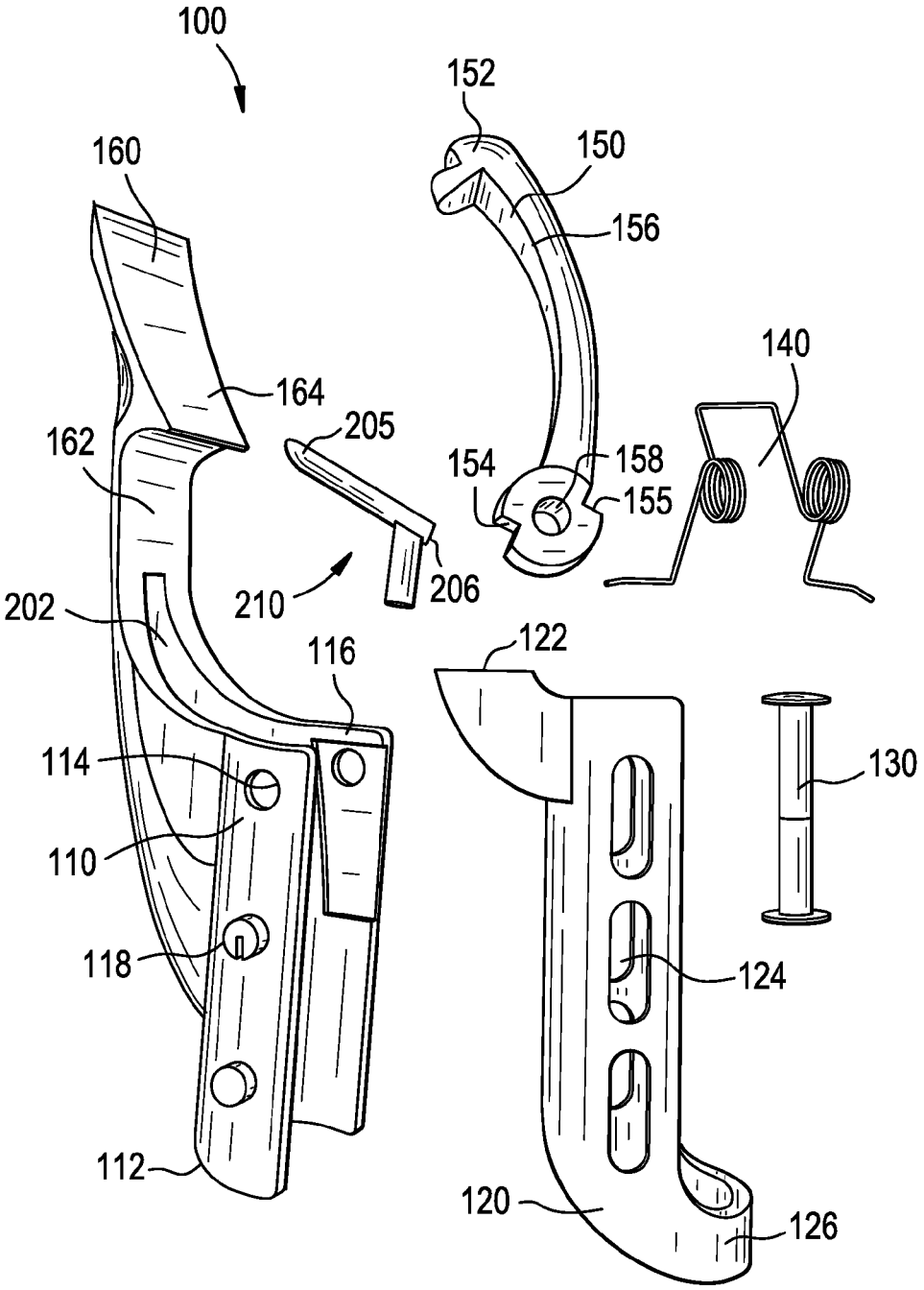
FIG. 1 depicts an exploded view of a retrieval tool, according to an embodiment.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help to improve understanding of various embodiments of the present disclosure. Also, common but well-understood elements that are useful or necessary in a commercially feasible embodiment are often not depicted in order to facilitate a less obstructed view of these various embodiments of the present disclosure.

DETAILED DESCRIPTION

In the following description, numerous specific details are set forth in order to provide a thorough understanding of the present embodiments. It will be apparent, however, to one having ordinary skill in the art that the specific detail need not be employed to practice the present embodiments. In other instances, well-known materials or methods have not been described in detail in order to avoid obscuring the present embodiments.

FIG. 1 depicts an exploded view of a retrieval tool 100, according to an embodiment. Retrieval tool 100 may be utilized to retrieve, grasp, hold, carry an object. In embodiments described herein, retrieval tool 100 may be utilized to grasp an object such as a golf disc, which may be located in an obstacle or hard to reach area. Retrieval tool 100 may include a base 110, trigger slide 120, shaft 130, spring 140, and lever 150.

Base 110 may be a primary structure for the retrieval tool 100 for grasping objects. The base 110 may be configured to be coupled with the trigger slide 120, spring 140, shaft 130, and the lever 150. Base 110 may include a proximal end 112, body 116, distal end 164 and projections 118.

Proximal end 112 may include an attachment member (not shown), which may be configured to be coupled with a recoiling device (not shown), such as steel tape, a telescoping handle, etc. Utilizing the recoilable device a length associated with the retrieval tool 100 may increase or decrease. By adjusting the length of retrieval tool 100, retrieval tool 100 may be configured to extend to secure objects located at further distances from retrieval tool 100.

Body 116 may include shaft orifices 114, locking bar 210, and projections 118. The shaft orifices 114 may be holes extending through sidewalls of the body that are configured to allow the shaft 130 to be inserted through the body 116.

The locking bar 210 may be positioned on a lower, inner surface 202 of the body 116. The locking bar 210 may be configured to engage with portions 154 of the lever 150 to limit the movement of the lever 150 once the lever 150 is actuated. Front end 205 of locking bar 210 may be configured to be positioned adjacent to sidewalls of channel 202 within body 202. The forward movement of locking bar 210 may be reduced due to sidewalls of channel 202 encompassing front end 205. Furthermore, front end 205 of locking bar 210 may be positioned at a downward incline such that a rear end 206 of locking bar 210 is positioned higher than front end 205. In embodiments, channel 202 may have a downward incline that corresponds with the downward incline of locking bar 210.

Projections 118 may be positioned on an outer surface of body 116, wherein projections 118 may be configured to engage with sliding slots 124 within trigger slide 120. Projections 118 may be configured to assist and control the movement of trigger slide 120 along a linear path between proximal end 112 and distal end 164.

The distal end 164 may include a tip 160 and a staging area 162. The tip 160 may include an angled, planar surface. The angled, planar surface may be angled upward to increase a vertical offset of the planar surface from a ground surface from distal end 164 towards proximal end 112. The tip 160 may be configured to engage with an object, and allow the object to side on and over the tip 160.

The staging area 162 may include a first end with a concave sidewall positioned adjacent to the tip 160, and the staging area 162 may extend to body 116. The staging area 162 may be a substantially flat, planar surface that is configured to receive an object. The concave sidewall may be configured to have an overhang, such that once a curved object is positioned on staging area 162, portions of the object may be positioned under the overhang. This may assist in holding, securing, etc. the object in place.

The trigger slide 120 may be a device that is configured to slide with respect the base 110. In embodiments, trigger slide 120 may be configured to encompass body 116 of base 110. The trigger slide 120 may include an engagement mechanism 122, sliding slots 124, and lever lock 126.

The engagement mechanism 122 may be a projection positioned on a distal end of the trigger slide. Engagement mechanism 122 may be configured to engage with the object responsive to pushing retrieval tool 100 towards the object when the object is positioned on staging area 162. Engagement mechanism 122 may be a projection, outcrop, protrusion, etc. that is configured to extend past distal end of body 116. By extending past distal end of body 116, engagement mechanism 122 may receive force from the object when the object is positioned on staging area 162 and retrieval tool 100 is pushed towards the object. Responsive to the engagement mechanism 122 engaging with the object, the engagement mechanism may receive reciprocal force from the object to move the trigger slide 120 towards the proximal end 112 of base 110.

Sliding slots 124 may be orifices extending through the sidewalls of the trigger slide 120. The sliding slots 124 may have a length that is sufficient to allow the lever 150 to be engaged and disengaged with the lever lock 126. Furthermore, sliding slots 124 may be oval shaped passageways that are configured to guide the movement of trigger slide 120 along a linear axis. In embodiments, shaft 130 may be configured to be inserted through a first sliding slot 124, and projections 118 may be configured to be inserted through second and third sliding slots 124. Responsive to lever 150 being in a first mode and engaged with lever lock 126, shaft 130 and projections may be positioned more towards a rear of sliding slots 124 then when lever 150 is in a second mode and disengaged with lever lock 126.

The lever lock 126 may be a projection positioned on a proximal end of the trigger slide 120. Lever lock 126 may be configured to selectively engage with the lever 150. Responsive to lever lock 126 engaging with lever 150, the retrieval tool 100 may be in a first mode. Responsive to lever lock 126 disengaging with lever 150, the retrieval tool 100 may be in a second mode, which secures the object in place.

The shaft 130 may be a device that is configured to couple the base 110, trigger slide 120, spring 140, and lever 150 together. Shaft 130 may be configured to be inserted through base 110, trigger slide 120, and lever 150 such that the components are coupled together. Furthermore, shaft 130 may define an axis that lever 150 is configured to rotate about. In embodiments, a first end of lever 150 may be configured to be positioned outside of a first side of trigger slide 120, and a second end of lever 150 may be configured to be positioned outside of a second side of trigger slide 120. Shaft 130 may be configured to be secured in place within sliding slot 124, while allowing trigger slide 120 to move about shaft 130. By allowing trigger slide 120 to move about shaft 130, portions of lever 150 may be positioned under lever lock 126 to secure lever 150 in place in the first mode. Responsive to trigger slide moving rearward while lever 150 remains in a first position, portions of lever 150 may no longer be positioned under lever lock 126, which may allow lever 150 to pivot, rotate, etc. about shaft 130.

The spring 140 may be a device that is configured to be compressed and elongated. The spring 140 may be compressed and elongated based on the position of the lever 150 in relation to the lever lock 126. Furthermore, shaft 130 may be configured to secure spring 140 in place. In embodiments, spring 140 may be a torsion spring that is configured to operate by torsion or twisting. Spring 140 may be configured to store mechanical energy when it is twisted in a first direction, and exert a force in an opposite direction, second direction, when released. When positioning lever 150 under lever lock 126, spring 140 may store mechanical energy. When lever 150 is no longer positioned under lever lock 126, the mechanical energy may be exerted upon lever 150 to rotate lever 150 around shaft 130.

Lever 150 may be a device that is configured to be held in place by the lever lock 126 in a first mode, and rotate around shaft 130 to secure an object in place in a second mode. Lever 150 may include a locking mechanism 152 positioned on a first end of the lever, stopper 154 positioned on a second end of the lever, and an arm 156 positioned between the first end and the second end. The lever may also include an orifice 158, wherein the shaft 130 is configured to extend through the orifice 158.

Locking mechanism 152 may be a groove, shelf, indention, etc. positioned on the first end of lever 150. Locking mechanism 152 may be configured to engage with lever lock 126 in the first mode. When locking mechanism 152 is engaged with lever lock 126, the shelf may be positioned directly under and adjacent to lever lock 126. This may secure locking mechanism 152 in place.

Stopper 154 may be a notch or cutout positioned on the second end of lever 150. Notch 155 may be a notch or cutout positioned on the opposite side of orifice 158. Stopper 154 may be configured to allow lever 150 to rotate freely from the second mode to the first mode when disengaged from locking bar 210. In the first mode, locking bar 210 may be positioned within or proximal to notch 155, and lever 150 may still freely rotate due to a gap between the surfaces of notch 155 and locking bar 210. When trigger slide 120 moves towards the proximal end of base 110 and lever 150 rotates into second mode, stopper 154 may engage with the locking bar 210 to limit the rearward movement of lever 150. Responsive to locking bar 210 being embedded within stopper 154, lever 150 may not be able to move rearward.

Figure 2:
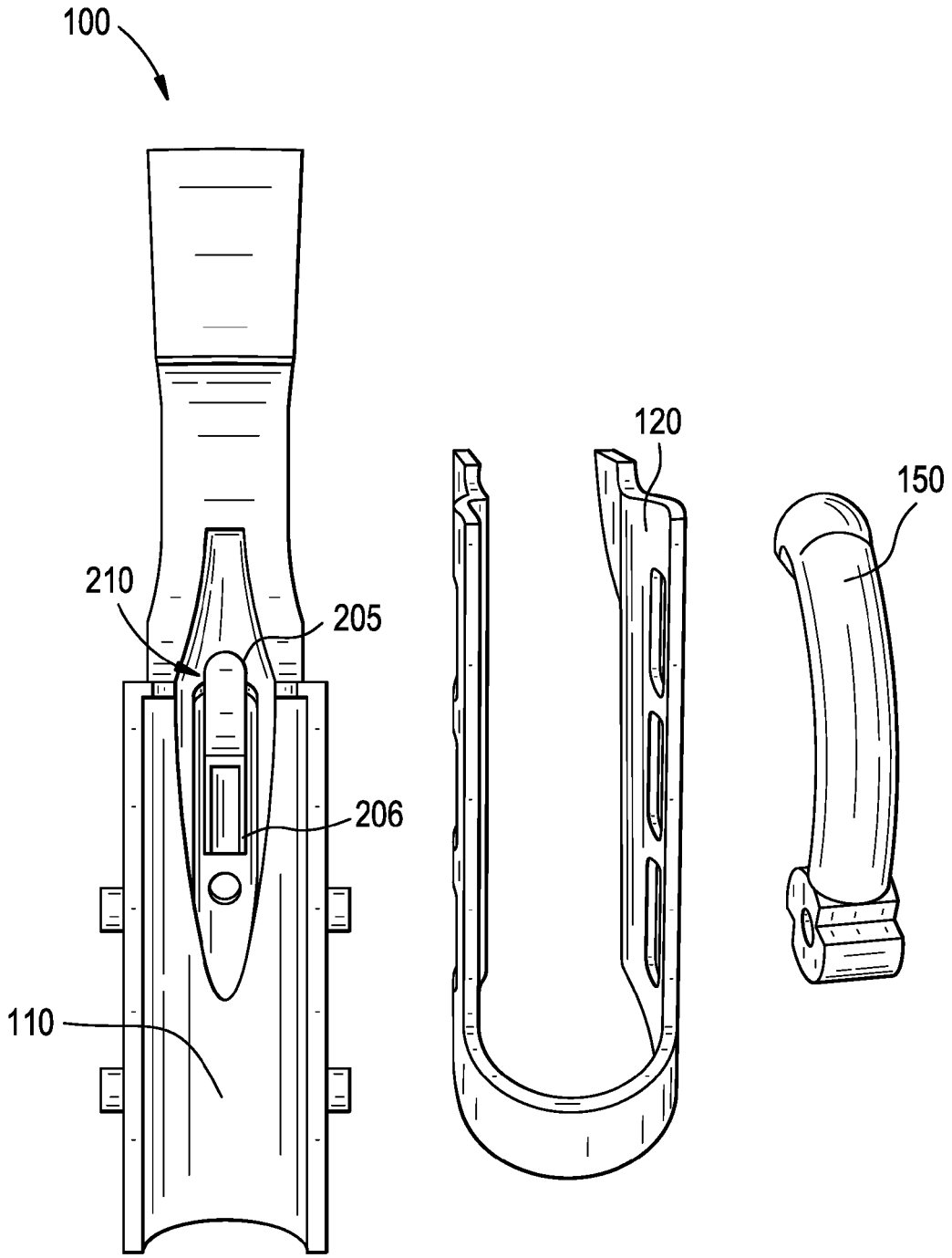
FIG. 2 depicts an exploded view of a retrieval tool, according to an embodiment.

In embodiments, to disengage lever 150 from locking bar 210, second end 206 of locking bar 210 may be pressed downward. This may disengage locking bar 210 from stopper 154, such that second end 206 of locking bar 210 is positioned below stopper 154. Responsive to disengaging locking bar 210 from stopper 154, lever 150 may be rotated from the second mode to the first mode. FIG. 2 depicts elements of a retrieval tool 100, according to an embodiment. Elements described in FIG. 2 may be described above. For the sake of brevity, an additional description of these elements is omitted.

As shown in FIG. 2, locking bar 210 may be positioned on a lower surface of base 110. Locking bar 210 may be a lever, bar, etc. that is configured to engage with stopper 154. Responsive to positioning stopper 154 adjacent to locking bar 210, lever 150 may not be able to rotate freely around shaft 130.

Figure 3:
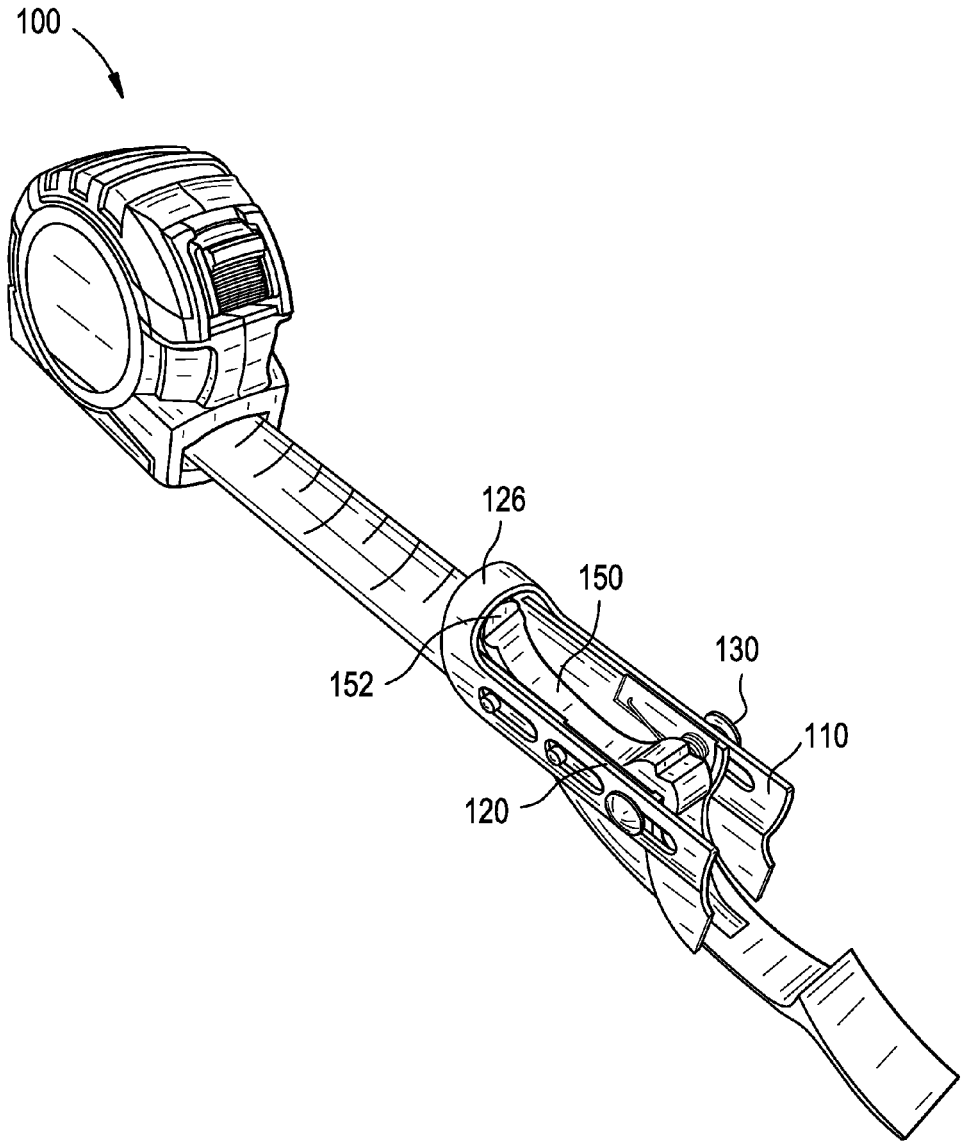
FIG. 3 depicts a perspective view of a retrieval tool in a first mode, according to an embodiment.

FIG. 3 depicts elements of a retrieval tool 100 in the first mode, according to an embodiment. Elements described in FIG. 3 may be described above. For the sake of brevity, an additional description of these elements is omitted.

As depicted in FIG. 3, when retrieval tool 100 is in the first mode, locking mechanism 152 may be positioned under lever lock 126. To position retrieval tool 100 in the first mode, lever 150 may be rotated rearward around shaft 130. Then, trigger slide 120 may be pulled forward while base 110 remains fixed in place until locking mechanism 152 is positioned under lever lock 126. Accordingly, to position retrieval tool 100 in the first mode, trigger slide 120 may move in a first linear direction with respect to a stationary base 110.

Figure 4:
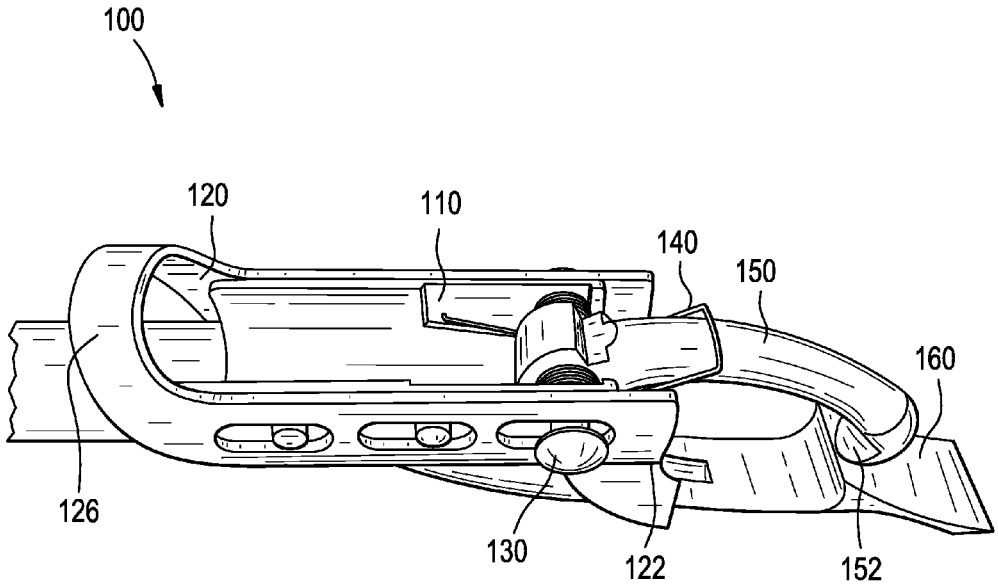
FIG. 4 depicts a perspective view of a retrieval tool in a second mode, according to an embodiment.

FIG. 4 depicts elements of a retrieval tool 100 in the second mode, according to an embodiment. Elements described in FIG. 4 may be described above. For the sake of brevity, an additional description of these elements is omitted.

As depicted in FIG. 4, in the second mode, lever 150 may be rotated about shaft 130. When rotated, locking mechanism 152 may be positioned over tip 160, wherein an object may be positioned between locking mechanism 152 and tip 160.

To move retrieval tool 100 from the first mode to the second mode, the object may apply force against engagement mechanism 122 of trigger slide 120 in a second linear direction, such that the object pushes trigger slide 120 rearward. Furthermore, while the object engages with trigger slide 120 base 110 may remain in place, which may correspondingly hold shaft 130 and the rotational axis of lever 150 in place. Accordingly, to position retrieval tool in the second mode, trigger slide 120 may move in a second linear direction with respect to a stationary base 100.

When trigger slide 120 moves in the second linear direction, lever lock 126 may correspondingly move in the second linear direction such that lever lock 126 is no longer positioned over locking mechanism 152. If lever lock 126 is no longer positioned over locking mechanism 152, nothing may be restricting the mechanical force applied to lever 150 by spring 160. Therefore, spring 160 may apply mechanical force to lever 150, forcing lever 150 to rotate around shaft 130.

Figure 5:
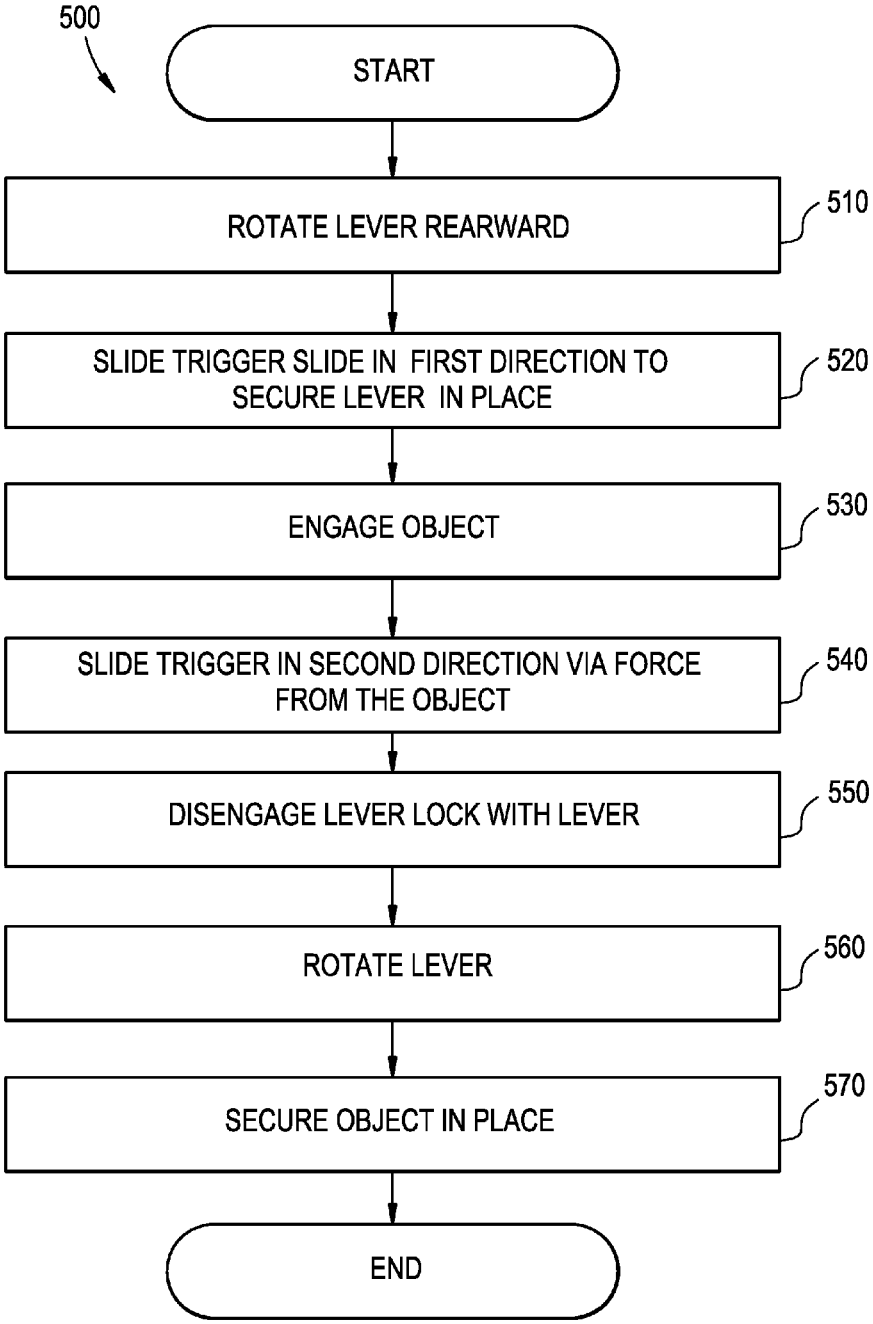
FIG. 5 depicts a method using a retrieval tool, according to an embodiment.

FIG. 5 depicts a method 500 for securing an object within a retrieval tool, according to an embodiment. The operations of method 500 presented below are intended to be illustrative. In some embodiments, method 500 may be accomplished with one or more additional operations not described, and/or without one or more of the operations discussed. Additionally, the order in which the operations of method 500 are illustrated in FIG. 5 and described below is not intended to be limiting.

At operation 510, a lever may be disengaged from locking bar and rotated in a first rotational direction about a shaft. The shaft may be coupled with a base to define a fixed axis of rotation with respect to the base.

At operation 520, a trigger slide may move in a first linear direction with respect to the base. Responsive to moving the trigger slide in the first linear direction, portions of the lever may be positioned adjacent to a lever lock, wherein the lever lock prevents rotation of the lever in a second rotational direction.

At operation 530, an object may be positioned on a staging area of the base, and engage with portions of the trigger slide.

At operation 540, responsive to engaging with the object, the object may apply force against the trigger slide. This force may cause the trigger slide to move in a second linear direction, wherein the second linear direction is in an opposite direction as the first linear direction.

At operation 550, responsive to moving the trigger slide in the second linear direction, the lever lock may no longer be positioned over the locking mechanism of the lever.

At operation 560, the lever may no longer be blocked, and may rotate in a second rotational direction about the shaft. The lever may rotate due to compression of a spring.

At operation 570, an arm of the lever may be positioned over the staging area and the object. This may secure the object in place. Furthermore, the lever may remain in place over the staging area due to the locking bar engaging with the stopper on the second end of the lever.

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

Reference throughout this specification to "one embodiment", "an embodiment", "one example" or "an example" means that a particular feature, structure or characteristic described in connection with the embodiment or example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale.

What is claimed is:

1. A retrieval tool comprising:

a base with a tip positioned on a distal end of the base;

a lever configured to rotate around a shaft, the lever including a locking mechanism positioned on a first end of the lever;

a trigger slide configured to move in a first linear direction and a second linear direction while the base remains stationary, the trigger slide including a sliding orifice, the trigger slide including a lever lock, wherein the shaft is configure to extend through the base, the lever, and the sliding orifice, the trigger slide being configured to move in the first linear direction to position the locking mechanism adjacent to the lever lock in a first mode, the trigger slide being configured to move in the second direction to disengage the locking mechanism with the lever lock in a second mode.

2. The retrieval tool of claim 1, further comprising:

a spring configured to apply mechanical force to the lever to rotate the lever around the shaft responsive to the locking mechanism disengaging with the lever lock.

3. The retrieval tool of claim 2, wherein the shaft is configured to extend through portions of the spring.

4. The retrieval tool of claim 1, wherein the tip includes an angled and planar upper surface.

5. The retrieval tool of claim 4, wherein the base includes a concave curved surface adjacent to the tip.

6. The retrieval tool of claim 1, wherein the first linear direction and the second linear direction are opposite directions.

7. The retrieval tool of claim 1, wherein the base includes a locking bar, and the lever includes a stopper, the locking bar being configured to engage with the stopper to limit a movement of the lever.

8. The retrieval tool of claim 1, wherein the trigger slide is configured to move in the second linear direction responsive to an object applying pressure against a distal end of the trigger slide.

9. The retrieval tool of claim 1, wherein the base includes a plurality of projections, and the trigger slide including a plurality of sliding orifices, the plurality of projections being configured to guide movement of the trigger slide in the first linear direction and the second linear direction.

10. The retrieval tool of claim 1, wherein the trigger slide is configured to be positioned on an outer surface of the base.

11. A method utilizing a retrieval tool comprising:

rotating a lever configured around a shaft, the lever including a locking mechanism positioned on a first end of the lever;

moving a trigger slide in a first linear direction to position the locking mechanism adjacent to a lever lock on the trigger slide, wherein the retrieval tool is in a first mode when the locking mechanism is positioned adjacent to the lever lock, wherein a base with a tip remains stationary while the trigger slide moves in the first linear direction wherein the base includes a locking bar, and the lever includes a stopper, the locking bar being configured to engage with the stopper to limit a movement of the lever;

moving the trigger slide in a second linear direction to disengage the locking mechanism with the lever lock, wherein the retrieval tool is positioned in a second mode when the locking mechanism is disengaged from the locking mechanism, wherein the base remains stationary while the trigger slide moves in the second linear direction.

12. The method of claim 11, further comprising:

applying, via a spring, mechanical force to the lever to rotate the lever around the shaft responsive to the locking mechanism disengaging with the lever lock.

13. The method of claim 12, wherein the shaft is configured to extend through portions of the spring.

14. The method of claim 11, wherein the tip includes an angled and planar upper surface.

15. The method of claim 14, wherein the base includes a concave curved surface adjacent to the tip.

16. The method of claim 11, wherein the first linear direction and the second linear direction are opposite directions.

17. The method of claim 11, further comprising:

moving the trigger slide in the second linear direction responsive to an object applying pressure against a distal end of the trigger slide.

18. The method of claim 11, wherein the trigger slide is configured to be positioned on an outer surface of the base.

19. A method utilizing a retrieval tool comprising:

rotating a lever configured around a shaft, the lever including a locking mechanism positioned on a first end of the lever;

moving a trigger slide in a first linear direction to position the locking mechanism adjacent to a lever lock on the trigger slide, wherein the retrieval tool is in a first mode when the locking mechanism is positioned adjacent to the lever lock, wherein a base with a tip remains stationary while the trigger slide moves in the first linear direction;

moving the trigger slide in a second linear direction to disengage the locking mechanism with the lever lock, wherein the retrieval tool is positioned in a second mode when the locking mechanism is disengaged from the locking mechanism, wherein the base remains stationary while the trigger slide moves in the second linear direction, wherein the base includes a plurality of projections, and the trigger slide including a plurality of sliding orifices, the plurality of projections being configured to guide movement of the trigger slide in the first linear direction and the second linear direction.

* * * * *